United States Patent [19]

Selden

[11] Patent Number: 4,885,667

[45] Date of Patent: Dec. 5, 1989

[54] GOOSENECK LAMP AND MAGNIFIER WITH IMPROVED CLAMP ASSEMBLY

[76] Inventor: Boynton Selden, 81 Uplands Dr., West Hartford, Conn. 06107

[21] Appl. No.: 314,487

[22] Filed: Feb. 23, 1989

[51] Int. Cl.[4] ..... F21V 33/00

[52] U.S. Cl. ..... 362/253; 362/285; 362/396; 362/430; 350/235

[58] Field of Search ..... 362/253, 285, 396, 418, 362/430, 457; 350/235; 248/160, 225.31, 231.5

[56] References Cited

U.S. PATENT DOCUMENTS

| | | | |
|---|---|---|---|
| D. 277,320 | 1/1985 | Selden | D26/51 |
| 1,090,984 | 3/1914 | Hawthorne | 362/427 |
| 1,295,522 | 2/1919 | Kirby | 248/276 |
| 1,735,212 | 12/1929 | Pawsat | 248/229 |
| 1,783,278 | 12/1930 | Brady | 350/235 |
| 3,543,017 | 11/1970 | Mihailoff | 362/86 |
| 4,796,162 | 1/1989 | Krogsrud | 362/253 |

*Primary Examiner*—Stephen F. Husar

[57] ABSTRACT

A gooseneck lamp assembly for clamping to a table includes a base member with a clamp portion at one end and a mounting portion for the gooseneck elements at the other end and a pivotable floating clamp with a vertically extending leg portion slidably seated in a slot in the clamp portion of the base member and a clamping leg portion extending forwardly therefrom beneath the clamp portion of the base member. The shank of a clamping bolt extends through the clamp portion of the base member and the clamping leg portion of the clamp, and a knob is threadably engaged on the portion of the shank extending above the base member so that rotation of the knob will effect pivoting of the free end of the clamping portion towards and away from the base member. A coil spring is provided about the shank of the clamping bolt between the clamp portion and the clamping leg portion to bias the free end of the clamping leg portion away from the clamp portion and thereby facilitate moving the clamping elements over the edge of the table. Bearing means is desirably provided between the knob and the base member to minimize friction, and a friction element is provided on the lower surface of the base member to minimize slipping on the associated table and to prevent marring of its surface.

10 Claims, 2 Drawing Sheets

GOOSENECK LAMP AND MAGNIFIER WITH IMPROVED CLAMP ASSEMBLY

BACKGROUND OF THE INVENTION

The present invention is directed to a gooseneck lamp assembly and, more particularly, to a gooseneck lamp assembly which has a clamping structure to facilitate its facile mounting upon tables of a substantial range of thickness.

Various devices have been proposed for use by persons with impaired vision or by craftspersons, which would provide in a single installation a light source for illuminating books or workpieces and a magnifying lens for viewing of the book or workpiece with the appropriate magnification. In U.S. Pat. No. Des. 277,320, Applicant has illustrated a combined lamp and magnifier unit disposed upon a clamp to permit its clamping on the edge of a table, workbench or the like. To effectuate the clamping action in the illustrated device, substantial force must be applied to the ends of the spring biased pivotal clamping members to spread the jaws apart for movement over the edge of the table or the like and there is also a restriction on the thickness of the table with which a particularly dimensioned clamp may be employed.

In hospital room and other settings, it has long been known that the visually impaired require effective illumination and frequently independent and self-supporting means for magnification of the books or the like which the patient may be using. Desk lamps and desk magnifiers placed upon the top surface of the table may be inadvertently knocked over and also frequently occupy a substantial portion of the space so as to minimize the table surface available for use by the person. Moreover, many elderly persons are troubled by arthritis or other conditions which minimize the strength in their hands, so that a clamping unit of the type shown in Applicant's prior patent does not represent a practical solution because of the strength required to open the jaws for clamping action.

Accordingly, it is an object of the present invention to provide a novel gooseneck lamp assembly which may be readily clamped upon a table by persons with relatively little strength in their hands and which will accommodate a substantial range of widths in the tables with which used.

It is also an object to provide such an assembly which is relatively compact and which is relatively stable when clamped upon the table.

Another object is provide such an assembly which may be readily fabricated and which is rugged in construction to provide relatively long life.

SUMMARY OF THE INVENTION

It has now been found that the foregoing and related objects and advantages may be readily attained in a gooseneck lamp assembly for facile clamping upon a table. A base member has a clamp portion adjacent one end thereof adapted to overlie the upper surface of the associated table and a mounting portion adjacent the other end thereof. The clamp portion has an axially elongated slot therein intermediate the ends thereof and an aperture therein forwardly of the slot. A floating clamp has a generally vertically extending leg portion having its upper end slidably seated in the slot and a clamping leg portion extending forwardly therefrom and having an aperture therein aligned with the aperture in the clamp portion of the base member. A clamping bolt has a shank extending through the aperture of the clamp portion of the base member and the clamping leg portion of the clamp.

A knob is disposed on the shank above the base member and is threadably engaged with the shank whereby rotation of the knob will effect pivoting of the free end of the clamping portion towards and away from the base member. Coil spring means is disposed about the shank of the clamping bolt between the clamp portion and clamping leg portion to bias the clamping leg portion away from the clamp portion. A flexible gooseneck arm is secured at its lower end to the mounting portion of the base member, and a lamp unit is disposed at the upper end of the gooseneck arm. Electrical wiring extends through the base member and gooseneck arm to power the lamp unit. As a result, the gooseneck lamp assembly may be readily secured to an associated hospital bed table by fitting the cooperating clamping portions thereover and rotating the knob to pivot the outer end of the clamping leg portion tightly against the lower surface of the associated table.

In the preferred embodiment, there is included bearing means about the shank between the knob and the base member, and this is desirably a ball bearing assembly. The clamping leg portion has an upwardly inclined section adjacent its free end.

Desirably, the clamp portion of the base member has a friction element on its lower surface to minimize slipping on the associated table and to prevent marring thereof. A second flexible gooseneck arm is secured at its lower end to the mounting portion of the base member and has a lens mounted on its upper end. The knob has an internally threaded metallic insert therein threadably receiving the shank. The upper end of the vertical leg portion of the clamp member is of T-shaped configuration with the arms of the T-shaped upper end overlying the base member.

DETAILED DESCRIPTION OF THE ILLUSTRATED EMBODIMENT

Figure 1:
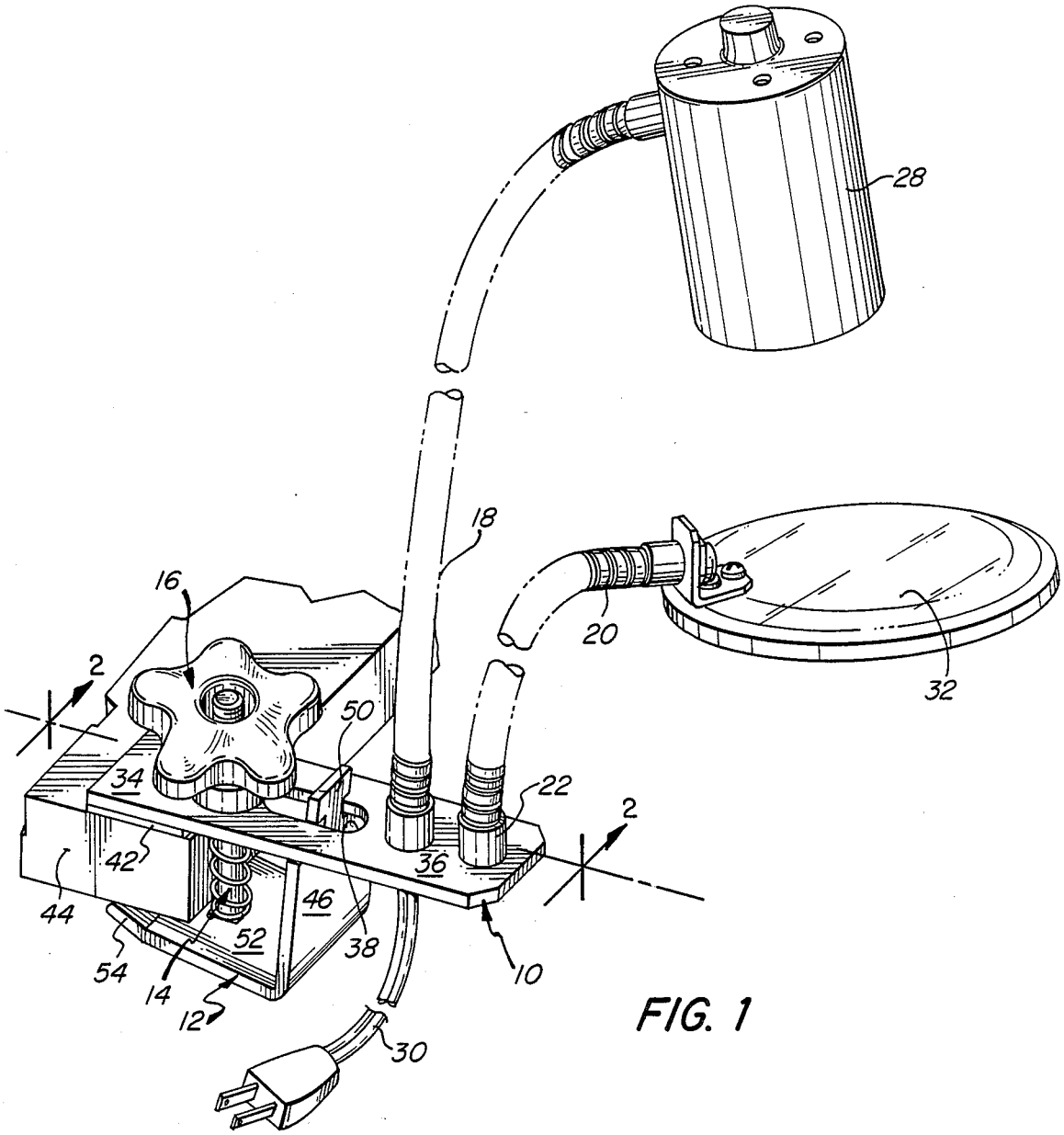
FIG. 1 is a perspective view of a clampable gooseneck lamp assembly embodying the present invention as mounted upon a fragmentarily illustrated table and with the electrical cord and gooseneck arms fragmentarily illustrated.
Figure 2:
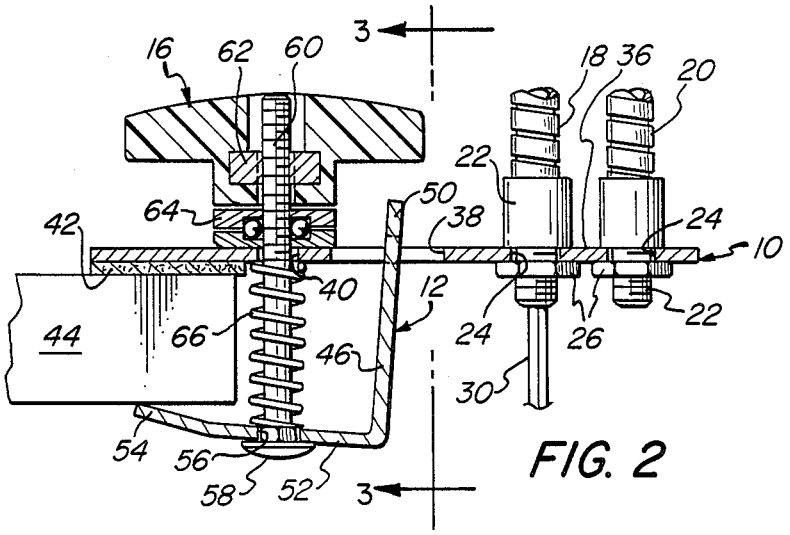
FIG. 2 is a fragmentary sectional view thereof along the line 2—2 of FIG. 1.
Figure 3:
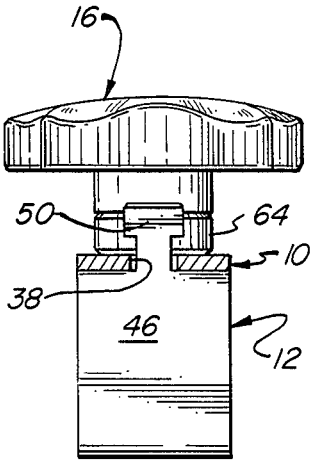
FIG. 3 is a sectional view thereof along the line 3—3 of FIG. 2.

Turning now in detail to FIGS. 1 and 2 of the attached drawings, a clampable gooseneck lamp assembly embodying the present invention includes an elongated base member generally designated by the numeral 10, a clamp member pivotably connected thereto and generally designated by the numeral 12, and a clamping screw assembly provided by the bolt generally designated by the numeral 14 and knob generally designated by the numeral 16.

The base member 10 has mounted on its distal portion a pair of flexible gooseneck arms 18,20 which have threaded couplings 22 extending through axially spaced apertures 24 in the base member 10 and nuts 26 tightened thereon against the lower surface of the base member 10. At the upper end of the arm 18 is a lamp 28 and an electrical cord 30 which extends upwardly through the coupling 22 and arm 28 to provide electrical power thereto. At the upper end of the arm 20 is a magnifying lens 32.

The base member 10 is conveniently provided by an elongated metallic plate and provides a clamp portion 34 at its proximal end and a mounting portion 36 at its distal end providing the apertures 24 for the gooseneck arms 18/20. Intermediate its length is an axially extending slot 38 and an aperture 40 is spaced therefrom towards the proximal end. Adhesively bonded to the lower surface of the proximal end is a strip 42 of felt, cork or the like to increase functional resistance to slipping and minimize the potential for marring the upper surface of the table 44.

The clamp member 12 has a vertically extending leg portion 46 with horizontal slots adjacent its upper end which provide a T-shaped head or pivot element 50 with arms which overlie the upper surface of the base member 10 on the sides of the slot 38. The clamp member 12 also has a clamping portion 52 extending generally horizontally and forwardly, with an upwardly inclined section 54 adjacent the front or free end thereof. The clamping portion 52 has a polygonal aperture 56 therein which is vertically aligned with the circular aperture 40 in the clamp portion 34.

The bolt 14 has a carriage bolt head 58 with a polygonal undersection which non-rotatably seats in the polygonal aperture 56 of the clamping portion 52, and the shank 60 is threaded over its upper portion. The knob 16 has an internally threaded metallic insert 62 which threadably engages the shank 60, and the upper end of the shank 60 is staked (not shown) to preclude inadvertent disassembly of the knob 16 therefrom.

To reduce friction as the knob 16 is tightened, a ball bearing assembly 64 is provided between the knob 16 and base member 10. To spread the forward end of the clamp member 12 from the base member 10 to facilitate sliding over the edge of the table 44, a coil spring 66 is disposed about the shank 60 and biases the forward end of the clamp member 12 downwardly.

Figure 4:
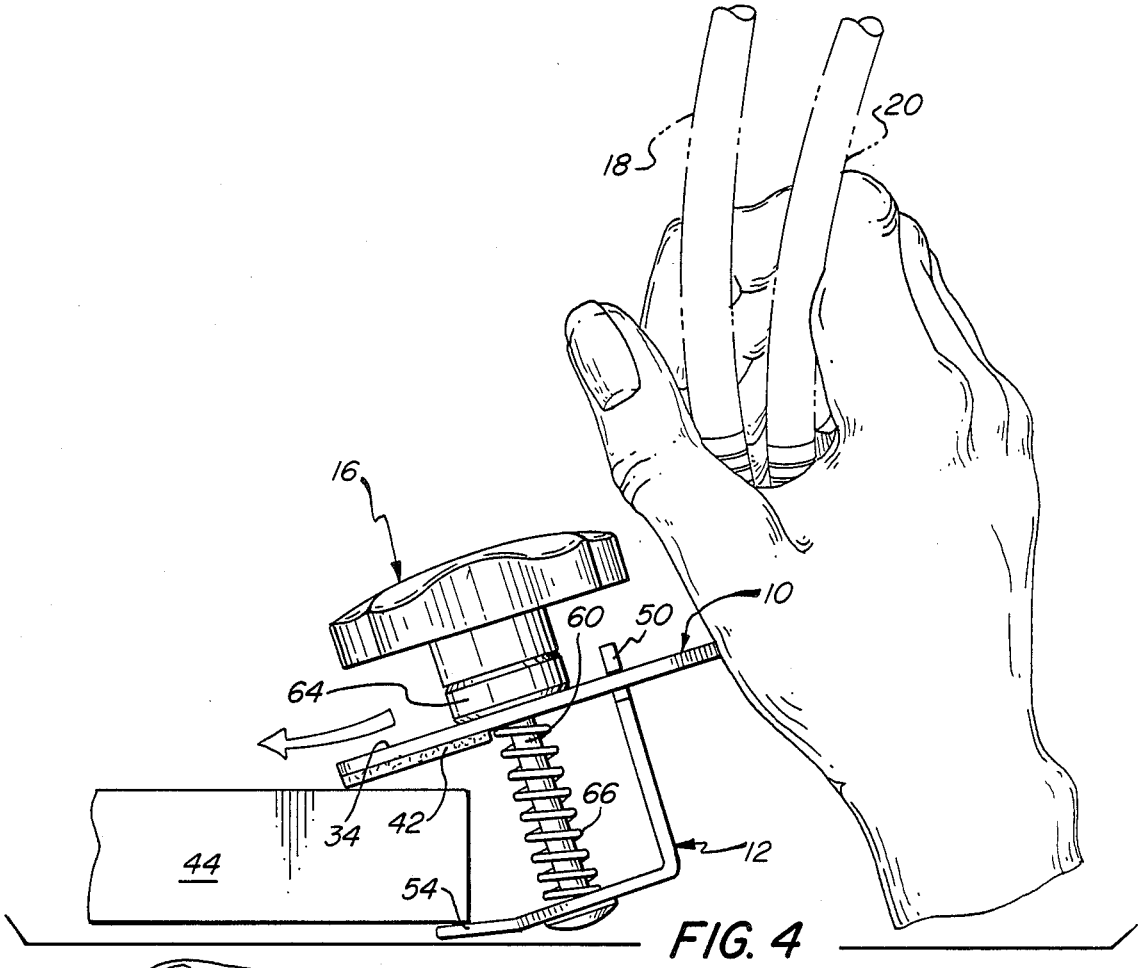
FIG. 4 is a fragmentary side elevational view of the gooseneck as being initially placed over the edge of fragmentarily illustrated table.
Figure 5:
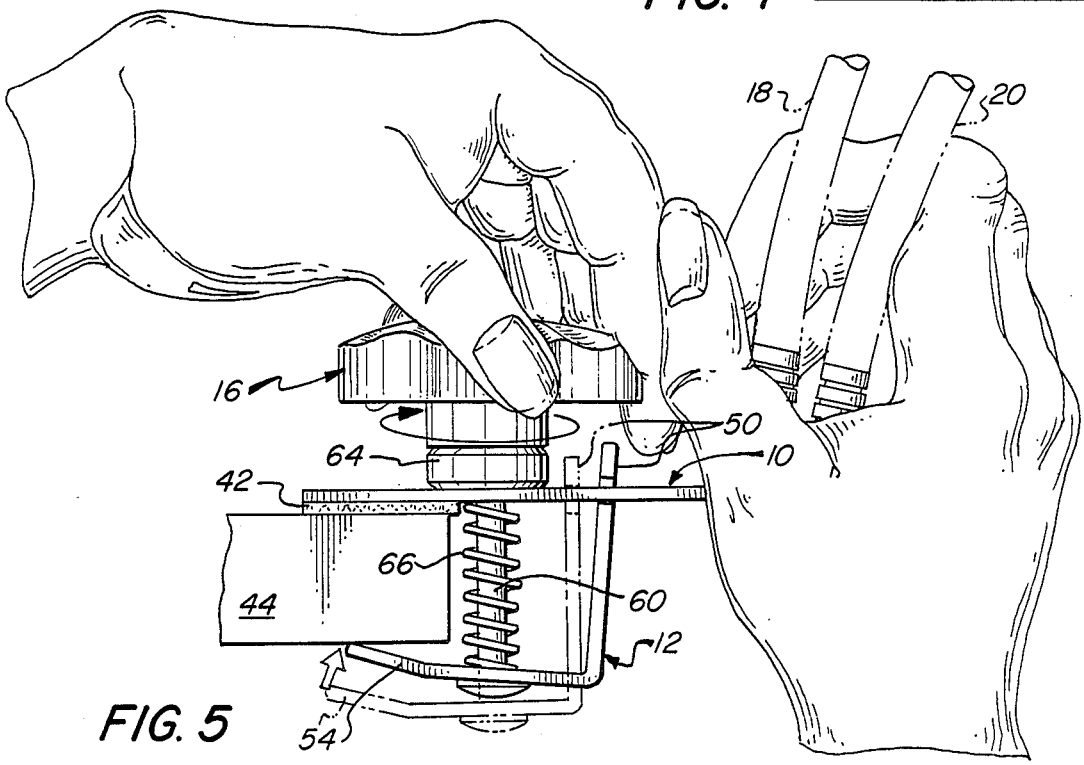
FIG. 5 is a similar view showing the knob being rotated to tighten the clamping elements securely against the table.

As seen in FIGS. 4 and 5, the gooseneck lamp assembly of the present invention may be readily mounted upon a hospital bed table or the like. Initially, the knob 16 is rotated to open the space between the clamping elements 34,52, and the spring 66 biases the inclined section 54 into a more open condition. As a result, the clamping elements 34,52 may be slid over the edge of the table 44 as shown in FIG. 4 without substantial pressure and without requiring any aqueezing of the clamping elements.

After the clamping elements have been positioned over the edge of the table 44, the knob 16 is freely rotated as shown in FIG. 5 to bring the inclined section 54 of the clamping portion 52 tightly against the lower surface of the table 44. As will be appreciated, the bearing 64 greatly facilitates rotation of the knob 16 and the tightening action to ensure good clamping pressure.

To remove the assembly from the table, it is only necessary that the user again rotate the knob 16 in the counterclockwise direction to loosen the clamping portion 52 sufficiently to allow the entire assembly to be slid off the end of the table 44.

As will be readily appreciated, the lens 32 and lamp 28 may be moved readily by bending the gooseneck arms 18,20 to provide the illumination and viewing orientations desired by the user.

By providing the elongated slot 38, the T-shaped head or pivot element 50 may be inserted through the slot 38 and then rotated 90° to position its arms over the base member 10. After the bolt 14 is inserted through the clamping elements and its knob 16 secured thereon, the clamp member 12 is now held in assembly. Because of the length of the slot 38, the upper end of the clamp member 12 may move along the base member 10 to change the point of pivoting. As a results, an assembly having a slot length of 0.82 inch, a depending vertical leg portion of 1.25 inches below the base member, and an overall length for the clamping portion of 1.5 inches, will function on tables of ½–1½ inches thickness.

To facilitate this broad range of clamping action, the inclined portion 54 is essential since it enables the clamp member free end to bite into the bottom surface of the table as it pivots.

Thus, it can be seen that the elements of the assembly may be readily fabricated and assembled to provide a long lived rugged and easily usable gooseneck lamp assembly for mounting on a hospital table. The assembly enables a patient with relatively little manual strength to easily mount and dismount the unit on the hospital table, and, when mounted, it is securely seated thereon. Moreover, the unit may be readily moved about the table by simply loosening the assembly sufficiently to permit its sliding motion along the surface of the table.

Having thus described the invention, what is claimed is:

1. In a gooseneck lamp assembly for facile clamping on a table, the combination comprising:

(a) a base member having a clamp portion adjacent one end thereof adapted to overlie the upper surface of the associated table and a mounting portion adjacent the other end thereof, said base member having an axially elongated slot therein intermediate said ends thereof and an aperture said clamp portion forwardly of said slot;

(b) a floating clamp having a generally vertically extending leg portion having its upper end slidably seated in said slot and a clamping leg portion extending forwardly therefrom and having an aperture therein aligned with said aperture in said clamp portion of said base member;

(c) a clamping bolt having a shank extending through said aperture of said clamp portion of said base member and said clamping leg portion of said clamp;

(d) a knob on said shank above said base member threadably engaged with said shank whereby rotation of said knob will effect pivoting of the free end of said clamping portion towards and away from said base member;

(e) coil spring means about said shank of said clamping bolt between said clamp portion and clamping leg portion to bias said clamping leg portion away from said clamp portion;

(f) a flexible gooseneck arm secured at its lower end to said mounting portion of said base member;

(g) a lamp unit at the upper end of said gooseneck arm; and (h) electrical wiring extending through said base member and gooseneck arm to power said lamp unit, said gooseneck lamp assembly being readily secured to an associated table by fitting the cooperating clamping portions thereover and rotating said knob to pivot said outer end of said clamping leg portion tightly against the lower surface of the associated table.

2. The gooseneck lamp assembly of claim 1 wherein there is included bearing means about said shank between said knob and said base member.

3. The gooseneck lamp assembly of claim 2 wherein said bearing means is a ball bearing assembly.

4. The gooseneck lamp assembly of claim 1 wherein said clamping leg portion has an upwardly inclined section adjacent its free end.

5. The gooseneck lamp assembly of claim 1 wherein said clamp portion of said base member has a friction element on its lower surface to minimize slipping on the associated table and to prevent marring thereof.

6. The gooseneck lamp assembly of claim 1 wherein there is included a second flexible gooseneck arm secured at its lower end to said mounting portion of said base member and having a lens mounted on its upper end.

7. The gooseneck lamp assembly of claim 1 wherein said knob has an internally threaded metallic insert therein threadably receiving said shank.

8. The gooseneck lamp assembly of claim 1 wherein the upper end of said vertical leg portion of said clamp member is of T-shaped configuration with the arms of the T-shaped upper end overlying the base member.

9. In a gooseneck lamp assembly for facile clamping on a table, the combination comprising:

(a) a base member having a clamp portion adjacent one end thereof adapted to overlie the upper surface of the associated table and a mounting portion adjacent the other end thereof, said base member having an axially elongated slot therein intermediate said ends thereof and an aperture said clamp portion forwardly of said slot, said clamp portion of said base member having a friction element on its lower surface to minimize slipping on the associated table and to prevent marring thereof;

(b) a floating clamp having a generally vertically extending leg portion having its upper end slidably seated in said slot and a clamping leg portion extending forwardly therefrom and having an aperture therein aligned with said aperture in said clamp portion of said base member, said clamping leg portion having an upwardly inclined section adjacent its free end;

(c) a clamping bolt having a shank extending through said aperture of said clamp portion of said base member and said clamping leg portion of said clamp;

(d) a knob on said shank above said base member threadably engaged with said shank whereby rotation of said knob will effect pivoting of the free end of said clamping portion towards and away from said base member;

(e) coil spring means about said shank of said clamping bolt between said clamp portion and clamping leg portion to bias said clamping leg portion away from said clamp portion;

(f) bearing means about said shank between said knob and said base member;

(g) a flexible gooseneck arm secured at its lower end to said mounting portion of said base member;

(h) a lamp unit at the upper end of said gooseneck arm; and (i) electrical wiring extending through said base member and gooseneck arm to power said lamp unit, said gooseneck lamp assembly being readily secured to an associated table by fitting the cooperating clamping portions thereover and rotating said knob to pivot said outer end of said clamping leg portion tightly against the lower surface of the associated table.

10. In a gooseneck lamp assembly for facile clamping on a table, the combination comprising:

(a) a base member having a clamp portion adjacent one end thereof adapted to overlie the upper surface of the associated table and a mounting portion adjacent the other end thereof, said base member having an axially elongated slot therein intermediate said ends thereof and an aperture said clamp portion forwardly of said slot;

(b) a floating clamp having a generally vertically extending leg portion having its upper end slidably seated in said slot and a clamping leg portion extending forwardly therefrom and having an aperture therein aligned with said aperture in said clamp portion of said base member, said clamping leg portion having an upwardly inclined section adjacent it free end, the upper end of said vertical leg portion of said clamp member being of T-shaped configuration with the arms of the T-shaped upper end overlying said base member;

(c) a clamping bolt having a shank extending through said aperture of said clamp portion of said base member and said clamping leg portion of said clamp;

(d) a knob on said shank above said base member threadably engaged with said shank whereby rotation of said knob will effect pivoting of the free end of said clamping portion towards and away from said base member;

(e) coil spring means about said shank of said clamping bolt between said clamp portion and clamping leg portion to bias said clamping leg portion away from said clamp portion;

(f) bearing means about said shank between said knob and said base member;

(g) a first flexible gooseneck arm secured at its lower end to said mounting portion of said base member with a lamp unit at the upper end of said gooseneck arm, and electrical wiring extending through said base member and gooseneck arm to power said lamp unit; and (h) a second flexible gooseneck arm secured at its lower end to said mounting portion of said base member and having a lens mounted on its upper end, said gooseneck lamp assembly being readily secured to an associated table by fitting the cooperating clamping portions thereover and rotating said knob to pivot said outer end of said clamping leg portion tightly against the lower surface of the associated table.

* * * * *